US009651061B2

(12) United States Patent
Matsuzaki

(10) Patent No.: US 9,651,061 B2
(45) **Date of Patent: *May 16, 2017**

(54) HYDRAULIC CONTROL APPARATUS AND METHOD

(71) Applicant: SUMITOMO HEAVY INDUSTRIES, LTD., Tokyo (JP)

(72) Inventor: Eisuke Matsuzaki, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 312 days.

This patent is subject to a terminal disclaimer.

(21) Appl. No.: 14/217,721

(22) Filed: Mar. 18, 2014

(65) Prior Publication Data

US 2014/0196793 A1 Jul. 17, 2014

Related U.S. Application Data

(63) Continuation of application No. PCT/JP2012/070356, filed on Aug. 9, 2012.

(30) Foreign Application Priority Data

Sep. 21, 2011 (JP) ..... 2011-206443

(51) Int. Cl.
*F15B 1/033* (2006.01)
*F15B 11/16* (2006.01)
(Continued)

(52) U.S. Cl.
CPC ..... *F15B 1/033* (2013.01); *E02F 3/32* (2013.01); *E02F 9/2228* (2013.01);
(Continued)

(58) Field of Classification Search
CPC ..... F15B 11/165; F15B 2211/50536; F15B 2211/513; F15B 2211/6306; F15B 2211/6346
See application file for complete search history.

(56) References Cited

U.S. PATENT DOCUMENTS 5,873,245 A 2/1999 Kato et al.
6,199,378 B1 * 3/2001 Aardema ..... F15B 11/006 60/468
(Continued)

FOREIGN PATENT DOCUMENTS

EP 0349092 1/1990
EP 0462590 12/1991
(Continued)

OTHER PUBLICATIONS

International Search Report mailed on Oct. 9, 2012.

*Primary Examiner* — Eric Keasel
*Assistant Examiner* — Matthew Wiblin
(74) *Attorney, Agent, or Firm* — IPUSA, PLLC

(57) ABSTRACT

A hydraulic control apparatus is disclosed which includes an unloading valve controlling part; an command value calculating part configured to calculate, based on an operation amount of an operation member for changing a position of the directional control valve and a discharge pressure of the hydraulic pump, a virtual negative control pressure, and calculates a control command value for the hydraulic pump based on the virtual negative control pressure; and a correcting part configured to operate under the situation where the directional control valve is in such a state that the fluid path to the hydraulic actuator is closed, wherein the correcting part corrects the control command value or a parameter, which is used in calculating the control command value, such that a discharge flow rate of the hydraulic pump is a predetermined flow rate.

4 Claims, 10 Drawing Sheets

(51) Int. Cl.
*E02F 9/22* (2006.01)
*E02F 3/32* (2006.01)

(52) U.S. Cl.
CPC ..... *E02F 9/2235* (2013.01); *E02F 9/2267* (2013.01); *E02F 9/2296* (2013.01); *F15B 11/165* (2013.01); *F15B 2211/3111* (2013.01); *F15B 2211/50536* (2013.01); *F15B 2211/526* (2013.01); *F15B 2211/6309* (2013.01); *F15B 2211/6346* (2013.01); *F15B 2211/665* (2013.01); *F15B 2211/6652* (2013.01); *Y10T 137/0318* (2015.04); *Y10T 137/86027* (2015.04)

(56) References Cited

U.S. PATENT DOCUMENTS

| | | | | |
|---|---|---|---|---|
| 6,438,953 | B1 | 8/2002 | Kamada | |
| 6,973,779 | B2 * | 12/2005 | Naaktgeboren | A01B 63/32 60/328 |
| 2009/0308068 | A1 * | 12/2009 | Yoshino | E02F 9/2203 60/468 |
| 2013/0298542 | A1 * | 11/2013 | Lowman | F15B 11/00 60/327 |

FOREIGN PATENT DOCUMENTS

| | | |
|---|---|---|
| EP | 0597109 | 5/1994 |
| JP | 60-245804 | 12/1985 |
| JP | 04-258504 | 9/1992 |
| JP | 07-042709 | 2/1995 |
| JP | 09-236101 | 9/1997 |
| JP | 10-047306 | 2/1998 |
| JP | 11-303809 | 11/1999 |

* cited by examiner (A)

(B)

HYDRAULIC CONTROL APPARATUS AND METHOD

CROSS-REFERENCE TO RELATED APPLICATIONS

This is a continuation of International Application No. PCT/JP2012/070356, filed on Aug. 9, 2012, which is based upon and claims the benefit of priority of the prior Japanese Patent Application No. 2011-206443, filed on Sep. 21, 2011, the entire contents of which are hereby incorporated by reference.

FIELD

The disclosure is related to a hydraulic control apparatus and a method that controls a hydraulic pump in a construction machine in which a hydraulic actuator is connected to the hydraulic pump via a directional control valve of a closed center type, and in which an unloading valve, which is connected to a tank, is provided between the directional control valve and the hydraulic pump.

BACKGROUND

A control method for a variable volume pump is known in which, instead of an ordinary bleed control for controlling a hydraulic actuator speed by changing a bleed flow rate according to an operation amount of a control valve, a directional control valve of a closed center type is used, while a virtual bleed opening is set in the control valve and an area of the bleed opening (virtual bleed opening area) is changed according to the operation amount. According to the control method, a necessary pump discharge pressure is calculated using the virtual bleed opening area and a virtual bleed amount derived therefrom to perform the pump control such that the pump discharge pressure is implemented.

However, because only the virtual bleed opening is set and a negative control restriction is not assumed, a virtual negative control system is not replicated. As is generally known, the negative control system is in touch with human sensibilities, because the speed of the hydraulic actuator is low when a load is high while the speed of the hydraulic actuator is high when the load is low. On the other hand, if the virtual negative control system is replicated using a directional control valve of a closed center type, it becomes necessary to provide an unloading valve upstream from the directional control valve so as to discharge an excess flow rate from the hydraulic pump to the tank when the flow path in the directional control valve to the hydraulic actuator is closed. However, during discharging the excess flow rate with the unloading valve, the discharge pressure of the hydraulic pump becomes close to 0 because of little restriction. In this case, if the virtual negative control system is replicated based on such a discharge pressure of the hydraulic pump, such an command value (that instructs a maximum flow rate, for example) that causes the discharge flow rate of the hydraulic pump to increase is generated, which leads to a problem that energy is wasted.

SUMMARY

According to an aspect of the disclosure, a hydraulic control apparatus is provided which controls a hydraulic pump in a construction machine in which a hydraulic actuator is connected to the hydraulic pump via a directional control valve of a closed center type, and in which an unloading valve, which is connected to a tank, is provided between the directional control valve and the hydraulic pump, the hydraulic control apparatus comprising:

an unloading valve controlling part configured to control the unloading valve such that fluid communication between the hydraulic pump and the tank is blocked in a situation where the directional control valve is in such a state that a fluid path to the hydraulic actuator is opened, and such that the fluid communication between the hydraulic pump and the tank is established in a situation where the directional control valve is in such a state that a fluid path to the hydraulic actuator is closed;

an command value calculating part configured to operate under the situation where the directional control valve is in such a state that the fluid path to the hydraulic actuator is opened, wherein the command value calculating part calculates, based on an operation amount of an operation member for changing a position of the directional control valve and a discharge pressure of the hydraulic pump, a virtual negative control pressure when a negative control system is assumed, and calculates a control command value for the hydraulic pump based on the virtual negative control pressure; and a correcting part configured to operate under the situation where the directional control valve is in such a state that the fluid path to the hydraulic actuator is closed, wherein the correcting part corrects the control command value or a parameter, which is used in calculating the control command value, such that a discharge flow rate of the hydraulic pump is a predetermined flow rate.

DESCRIPTION OF EMBODIMENTS

In the following, embodiments will be described with reference to the accompanying drawings.

Figure 1:
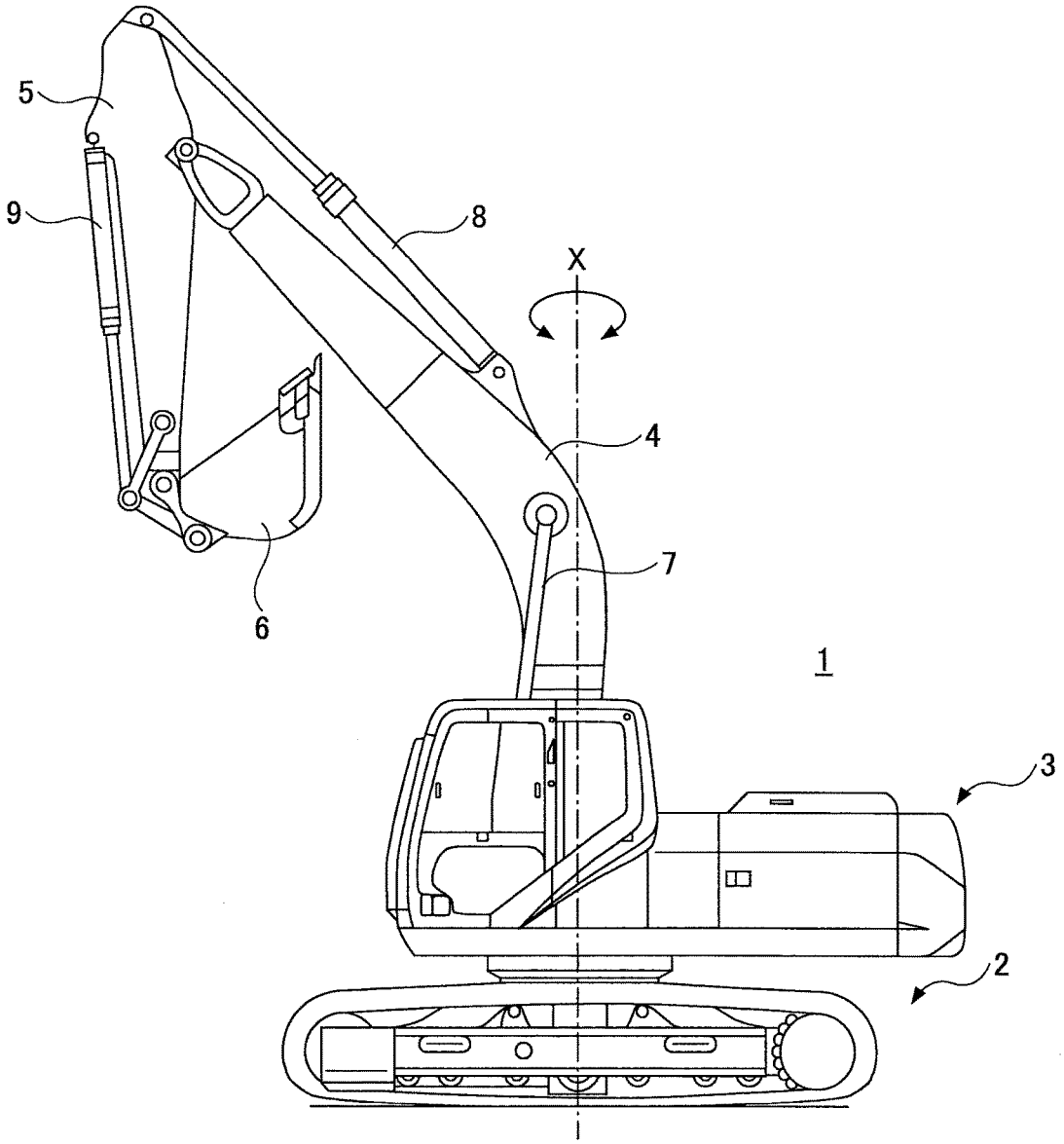
FIG. 1 is a diagram for illustrating an example of a configuration of a construction machine 1 according to an embodiment of the present invention.

FIG. 1 is a diagram for illustrating an example of a configuration of a construction machine according to an embodiment of the present invention. The construction machine 1 is a machine that has a hydraulic system operated by a human installed thereon, such as a hydraulic shovel, a folk lift, a crane. In FIG. 1, the construction machine 1 includes an upper rotating body 3 mounted on a lower traveling body of a crawler type via a rotating mechanism such that the upper rotating body 3 is rotatable around an X axis. Further, the upper rotating body 3 includes an excavation attachment at a forward center thereof that includes a boom 4, an arm 5 and a bucket 6 as well as a boom cylinder 7, an arm cylinder 8 and a bucket cylinder 9 as hydraulic actuator for driving them, respectively. The excavation attachment may be another attachment such as a breaker, a crusher, etc.

Figure 2:
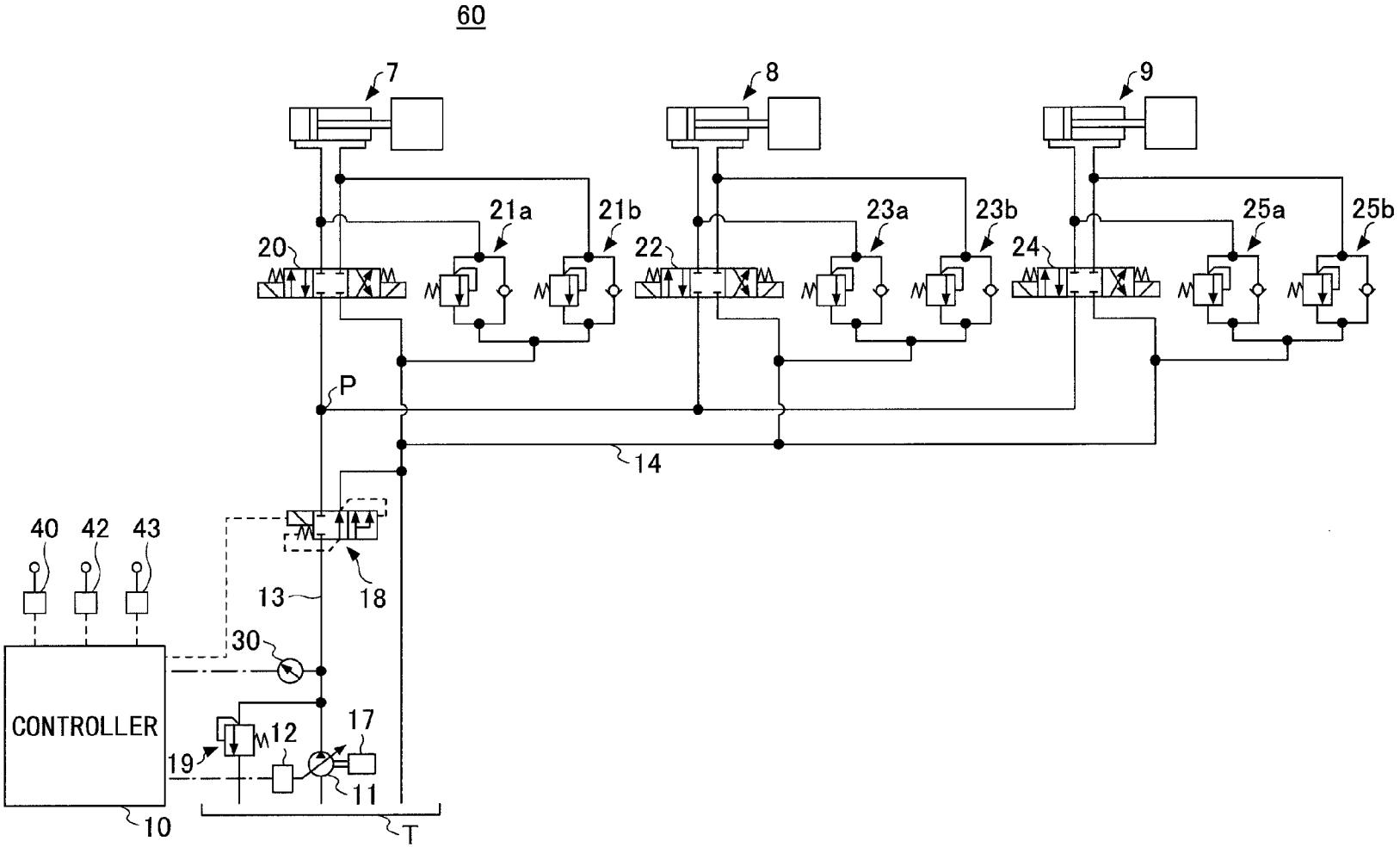
FIG. 2 is a diagram for illustrating a hydraulic circuit of a hydraulic control system 60 according to the embodiment.

FIG. 2 is a diagram for illustrating a hydraulic circuit of a hydraulic control system 60 according to the embodiment. The hydraulic control system 60 includes a hydraulic pump 11 of a variable volume type with which a discharge amount per a revolution (cc/rev) is variable. The hydraulic pump 11 is connected to a motor (for example, an engine) 17 and driven to rotate by the motor 17. The hydraulic pump 11 is connected to the boom cylinder 7, the arm cylinder 8 and the bucket cylinder 9 (examples of the hydraulic actuator) via a supply line 13 and directional control valves of a closed center type (control valves) 20, 22 and 24 in parallel. Further, a return line 14, which is connected to a tank T, is connected to the boom cylinder 7, the arm cylinder 8 and the bucket cylinder 9 via the directional control valves 20, 22 and 24. The hydraulic pump 11 is controlled by a regulator apparatus 12. It is noted that the directional control valves 20, 22 and 24 may be of a type in which a position control is hydraulically performed or of a type in which a position control is electronically performed with an electric signal (drive signal) from the controller 10 as illustrated.

It is noted that the hydraulic control system 60 may include another actuator such as a hydraulic motor for traveling and a hydraulic motor for rotating. Further, the number of the hydraulic actuators is three in the example illustrated in FIG. 2; however, the number of the hydraulic actuators may be arbitrary including 1.

An oil pressure sensor 30 for detecting a discharge pressure (pump discharge pressure) of the hydraulic pump 11 is provided in the hydraulic line from the hydraulic actuator 11. The pressure sensor 30 may input an electrical signal according to the pump discharge pressure to the controller 10.

An unloading valve 18 is provided in the supply line 13. The unloading valve 18 is connected to the return line 14 connecting to the tank T. In this way, the supply line 13 is in fluid communication with the tank T via the unloading valve 18. The unloading valve 18 switches, according to the position thereof, between a state in which the supply line 13 is in fluid communication with the tank T and a state in which the supply line 13 is disconnected from the tank T. The unloading valve 18 may be controlled according to open/closed states of fluid paths (actuator lines) in the directional control valves 20, 22 and 24 to the respective actuators (the boom cylinder 7, the arm cylinder 8 and the bucket cylinder 9). For example, the unloading valve 18 may be closed when at least one of the actuator lines in the directional control valves 20, 22 and 24 is open such that the oil discharged from the hydraulic pump 11 is not discharged to the tank T. On the other hand, the unloading valve 18 may be opened when all the actuator lines in the directional control valves 20, 22 and 24 are closed to form such a state in which the oil discharged from the hydraulic pump 11 is discharged to the tank T. It is noted that the unloading valve 18 may be of a type in which a position control is hydraulically performed or of a type in which a position control is electronically performed with an electric signal as illustrated.

Further, a relief valve 19 is provided in the supply line 13. Further, the return line 14 is connected to head sides and rod sides of the boom cylinder 7, the arm cylinder 8 and the bucket cylinder 9 via corresponding relief valves 21*a*, 21*b*, 23*a*, 23*b*, 25*a* and 25*b*. It is noted that, in the illustrated example, the relief valves 21*a*, 21*b*, 23*a*, 23*b*, 25*a* and 25*b* include supplementary feed check valves. The relief valves 21*a*, 21*b*, 23*a*, 23*b*, 25*a* and 25*b* may be of a type in which a position control is hydraulically performed or of a type in which a position control is electronically performed with an electric signal as illustrated.

The controller 10 mainly includes a microprocessor that includes a CPU, a ROM in which control programs are stored, a RAM in which calculation results are stored, a timer, a counter, an input interface, an output interface, etc., for example.

Operation members 40, 42 and 43 are electrically connected to the controller 10. The operation members 40 and 42 are to be operated by a user for changing the positions of the directional control valves 20, 22 and 24 to operate the construction machine 1. The operation members 40 and 42 may be in a form of a lever or a pedal, for example. In this example, the operation members 40, 42 and 43 are an arm operation lever for operating the arm 5, a boom operation lever for operating the boom 4, and a bucket operation lever for operating the bucket 6, respectively. Operation amounts (strokes) of the operation members 40, 42 and 43 by the user are input to the controller 10 as electric signals. A way of detecting the operation amounts of the operation members 40, 42 and 43 by the user may be a way of detecting pilot pressures with pressure sensors or a way of detecting lever angles.

The controller 10 controls the directional control valves 20, 22 and 24 and the unloading valve 18 based on the operation amounts of the operation members 40, 42 and 43, etc. It is noted that if the directional control valves 20, 22 and 24 are of a type in which a position control is hydraulically performed, the directional control valves 20, 22 and are controlled directly by the pilot pressures that are changed according to the operations of the operation members 40, 42 and 43.

Further, the controller 10 controls the hydraulic pump 11 via the regulator apparatus 12 based on the operation amounts of the operation members 40, 42 and 43, etc. It is noted that a method of controlling the hydraulic pump 11 is described hereinafter in detail.

Next, features of a control method by the controller 10 according to the embodiment is described.

The controller 10 according to the embodiment replicates control characteristics of an open center type (negative control system) in the hydraulic circuit including the directional control valves 20, 22 and 24 of a closed center type illustrated in FIG. 2. Such a system is referred to as "a virtual bleed system" hereinafter.

Figure 3:
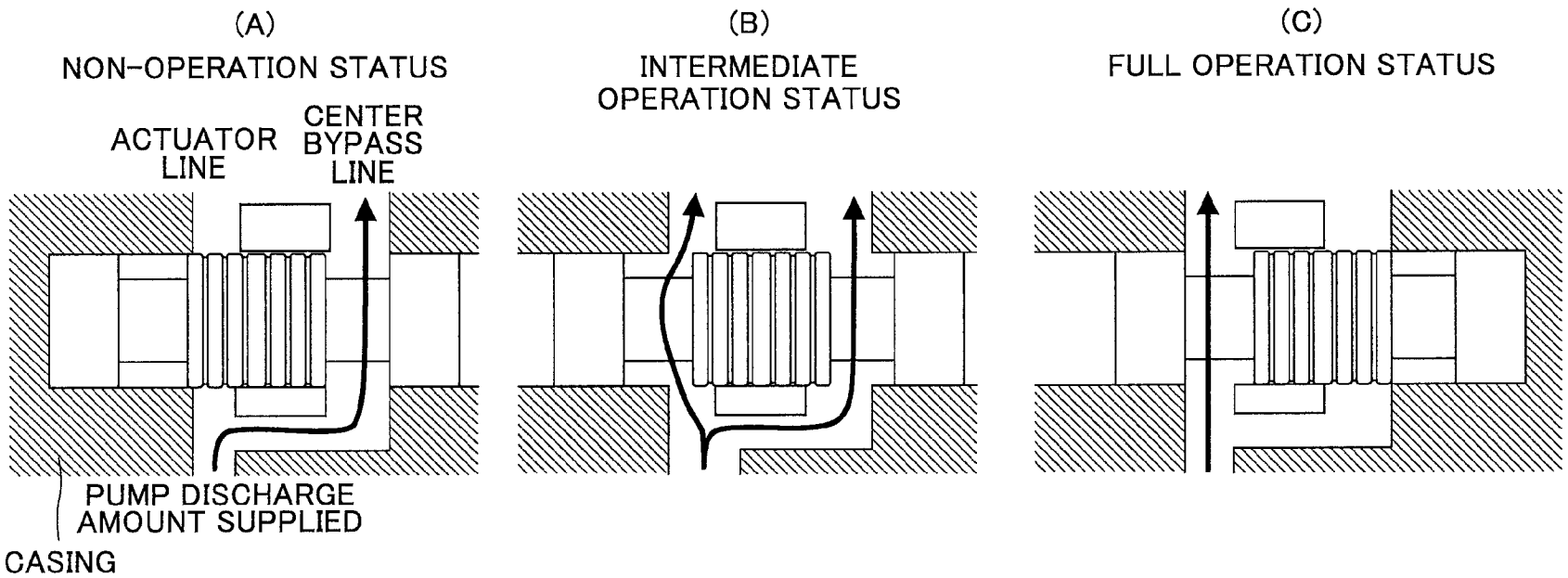
FIG. 3 is a diagram for schematically illustrating a directional control valve used in a (negative control) system of an open center type.

FIG. 3 is a diagram for schematically illustrating a directional control valve used in a (negative control) system of an open center type. In the negative control system, when the directional control valve is in its nominal state, an overall discharge flow rate of the hydraulic pump is unloaded to the tank via a center bypass line, as illustrated in FIG. 3 (A). For example, when the directional control valve is moved to the right side by the operation of the operation member, the flow path to the hydraulic actuator is opened and the center bypass line is narrowed, as illustrated in FIG. 3 (B). In the fully operated state, the center bypass line is fully closed such that the overall discharge flow rate of the hydraulic pump is supplied to the hydraulic actuator, as illustrated in FIG. 3 (C). These relationships can be expressed as follow.

$$Q_d = c_a A_a \sqrt{\frac{2(p_d - p_{act})}{\rho}} + c_b A_b \sqrt{\frac{2p_d}{\rho}} \quad \text{(formula 1)}$$

$\rho$ is a density, $Q_d$ and $p_d$ are discharge flow rate and discharge pressure of the hydraulic pump, $c_b$ and $A_b$ are a flow coefficient and an opening area (bleed opening area) in the directional control valve related to the center bypass line, $c_a$ and $A_a$ are a flow coefficient and an opening area in the directional control valve related to the actuator line, and $p_{act}$ is a actuator line pressure. In the negative control system, the center bypass line has a negative control restriction downstream from the directional control valve to be in fluid communication with the tank via the negative control restriction (see FIG. 7).

As is clear from the formula 1, when the actuator line pressure increases due to the increased load, a differential pressure ($p_d$-$p_{act}$) decreases, and thus the flow rate to the hydraulic actuator decreases. If the discharge flow rate $Q_d$ from the hydraulic pump is the same, the flow rate through the center bypass line is decreased. This means that the hydraulic actuator speed differs according to the load of the hydraulic actuator even at the same operation amount.

Figure 4:
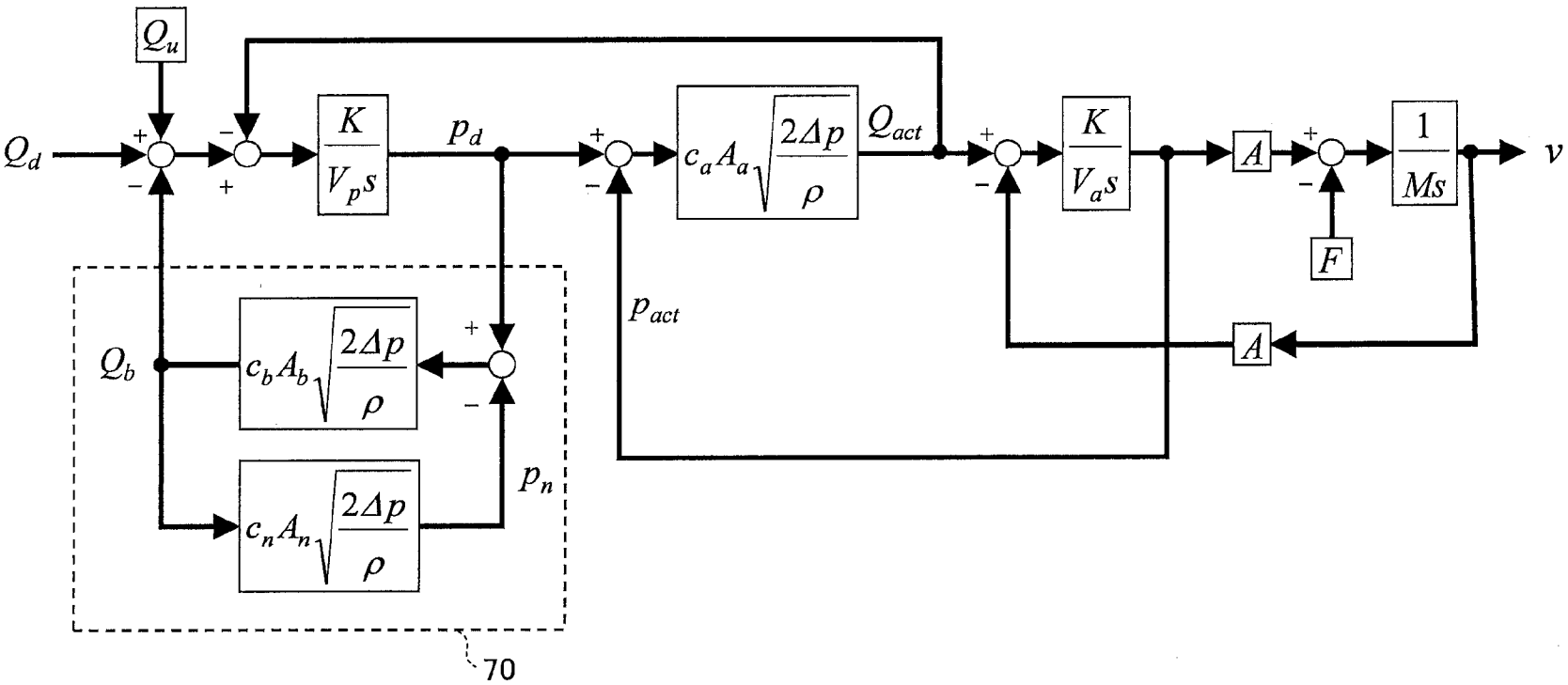
FIG. 4 is a block diagram for illustrating a negative control system that is replicated in a virtual bleed system implemented by a controller 10 according to the embodiment.

FIG. 4 is a block diagram for illustrating a negative control system that is replicated in a virtual bleed system implemented by a controller 10 according to the embodiment. It is noted that, in FIG. 4, $Q_b$ is a flow rate flowed through the unloading valve, K is a modulus of elasticity of volume, $V_p$ is a pump—control valve volume, $V_a$ is a control valve—cylinder volume, A is a cylinder pressure applied area, M is a cylinder volume, and F is a disturbance.

According to the embodiment, in order to replicate the negative control system in the virtual bleed system, a directional control valve of an open center type (see FIG. 3) is assumed as indicated by a block 70 in FIG. 4, a bleed part at this virtual directional control valve is calculated to calculate a virtual bleed amount $Q_b$, and a target value $Q_{dt}$ of the discharge amount of the hydraulic pump based on a control rule of the negative control system is subtracted the virtual bleed amount $Q_b$ to generate an command value to control the hydraulic pump 11.

The virtual bleed amount $Q_b$ may be calculated as follow, considering a fact that there is a back pressure in the center bypass line due to the negative control restriction in the actual negative control system. In other words, in the virtual bleed system, in order to model the actual negative control system, it is assumed that the negative control restriction is provided in the center bypass line from the virtual directional control valve, and the back pressure due to the negative control restriction may be considered.

$$Q_b = c_b A_b \sqrt{\frac{2(p_d - p_n)}{\rho}} \quad \text{[formula 2]}$$

$p_n$ is the back pressure (referred to as "virtual negative control pressure" hereinafter) due to the negative control restriction.

On the other hand, at a virtual negative control restriction, the following equation holds.

$$Q_b = c_n A_n \sqrt{\frac{2(p_n - p_t)}{\rho}} = c_n A_n \sqrt{\frac{2p_n}{\rho}} \quad \text{[formula 3]}$$

$p_t$ is a tank pressure and 0 in this example. A predetermined upper limit $p_{nmax}$ is set for the virtual negative control pressure $p_n$. The virtual negative control pressure $p_n$ may correspond to a setting pressure of the relief valve in the assumed negative control system.

The virtual negative control pressure $p_n$ can be expressed from the formula 2 and the formula 3 as follow.

$$p_n = \frac{(c_b A_b)^2}{(c_b A_b)^2 + (c_n A_n)^2} p_d \quad \text{[formula 4]}$$

From the formula 4, it can be seen that the virtual negative control pressure $p_n$ can be calculated from the discharge pressure $p_d$ of the hydraulic pump 11 based on a flow coefficient $c_b$ and an opening area $A_b$ in the directional control valve related to the center bypass line, and a flow coefficient $c_n$ and an opening area $A_n$ at the negative control restriction. The flow coefficient $c_b$, the opening area $A_b$, the flow coefficient $c_n$ and the opening area $A_n$ can be initially set to virtual values (thus, these are known values). The flow coefficient $c_n$ and the opening area $A_n$ are based on the assumed characteristics of the negative control restriction. An example of a characteristic of the opening area $A_b$ is described hereinafter.

In this way, even without an actual bleed opening (i.e., even without a center bypass line nor a negative control restriction), the virtual negative control pressure $p_n$, can be calculated from the discharge pressure $p_d$ of the hydraulic pump 11 (a detection value of the oil pressure sensor 30 or a dummy value, for example) based on the assumed characteristics of the negative control system (the flow coefficient $c_b$, the opening area $A_b$, the flow coefficient $c_n$ and the opening area $A_n$), and the discharge flow rate of the hydraulic pump 11 can be controlled based on the virtual negative control pressure $p_n$. In other words, the negative control system can be replicated by controlling the discharge flow rate of the hydraulic pump 11 such that the virtual negative control pressure $p_n$ is treated as a negative control pressure to be obtained in the negative control system.

Figure 5:
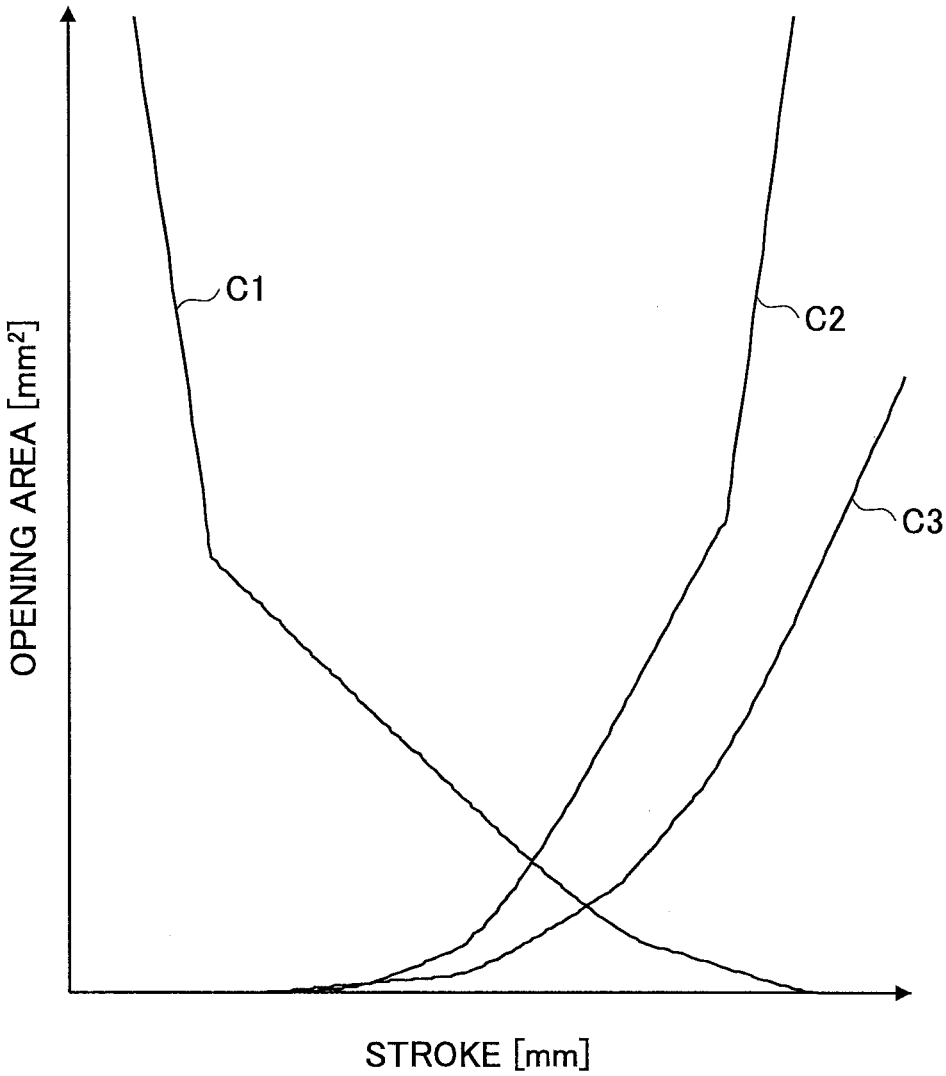
FIG. 5 is a diagram for illustrating an example of characteristics of a virtual directional control valve and a directional control valve.

FIG. 5 is a diagram for illustrating an example of characteristics of a virtual directional control valve and a directional control valve. Specifically, a characteristic C1 is a curve that represents a relationship between the operation amount (stroke) in the virtual directional control valve and the opening area (virtual bleed opening area) $A_b$. A characteristic C2 indicates an opening characteristic on a meter-in side in the directional control valve, and a characteristic C3 indicates an opening characteristic on a meter-out side in the directional control valve. A table that represents the characteristic C1 is prepared for each of the directional control valves 20, 22 and 24 as bleed opening data tables.

Figure 6:
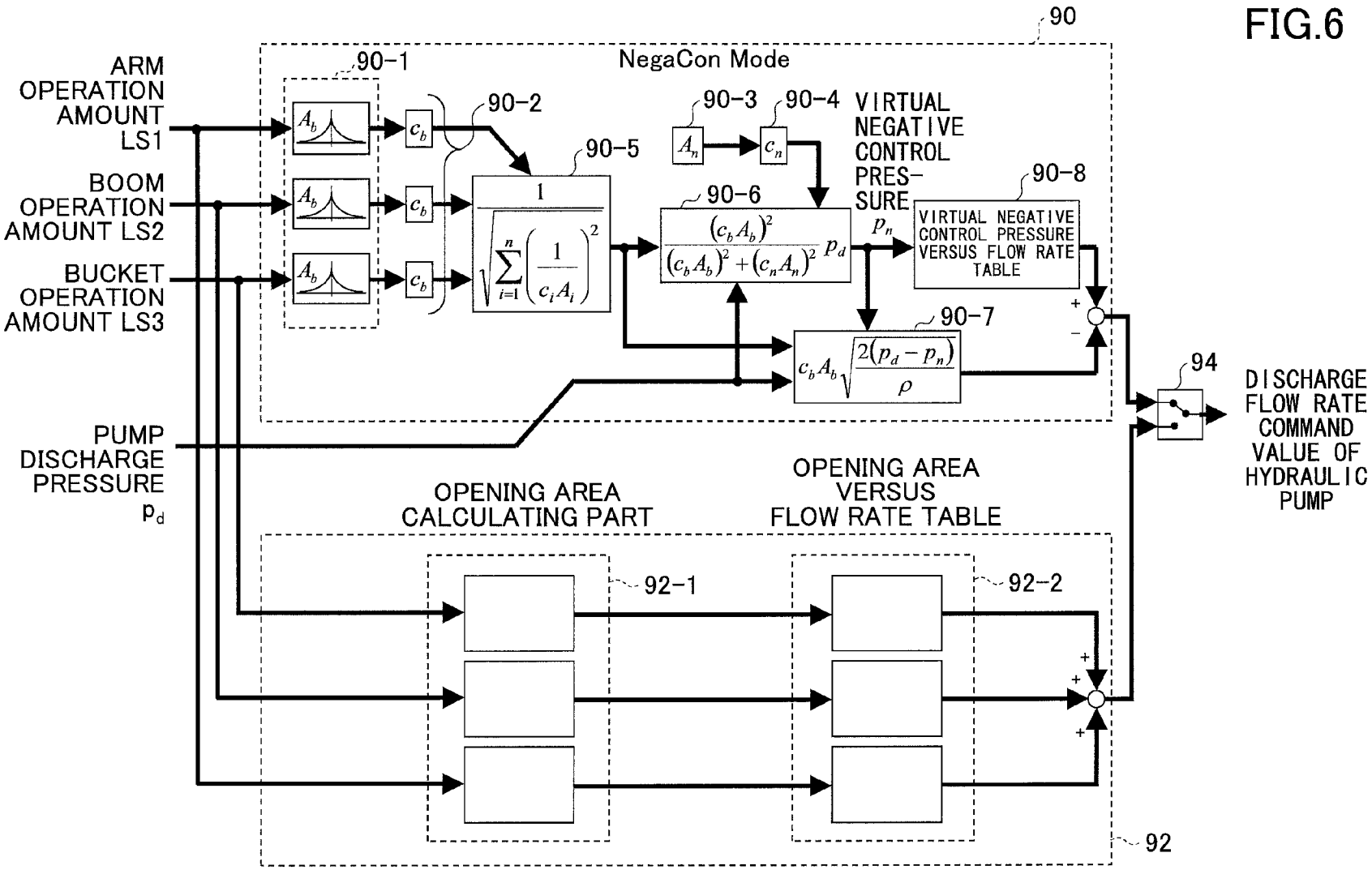
FIG. 6 is a base part of a block diagram for illustrating a virtual bleed system implemented by the controller 10 according to the embodiment.

FIG. 6 is a base part of a block diagram for illustrating a virtual bleed system implemented by the controller 10 according to the embodiment. It is noted that in the following such a configuration in which a positive control system and the negative control system are selectively implemented; however, only the negative control system may be implemented in the virtual bleed system. It is noted that the negative control system corresponds to a block 90 in FIG. 6 and the positive control system corresponds to a block 92 in FIG. 6. A control block of the positive control system is the same as an ordinary positive control system, and thus a control block of the negative control system, in particular, is described hereinafter. It is noted that the block 90 in FIG. 6 corresponds to a part of the block 70 in FIG. 4.

Figure 7:
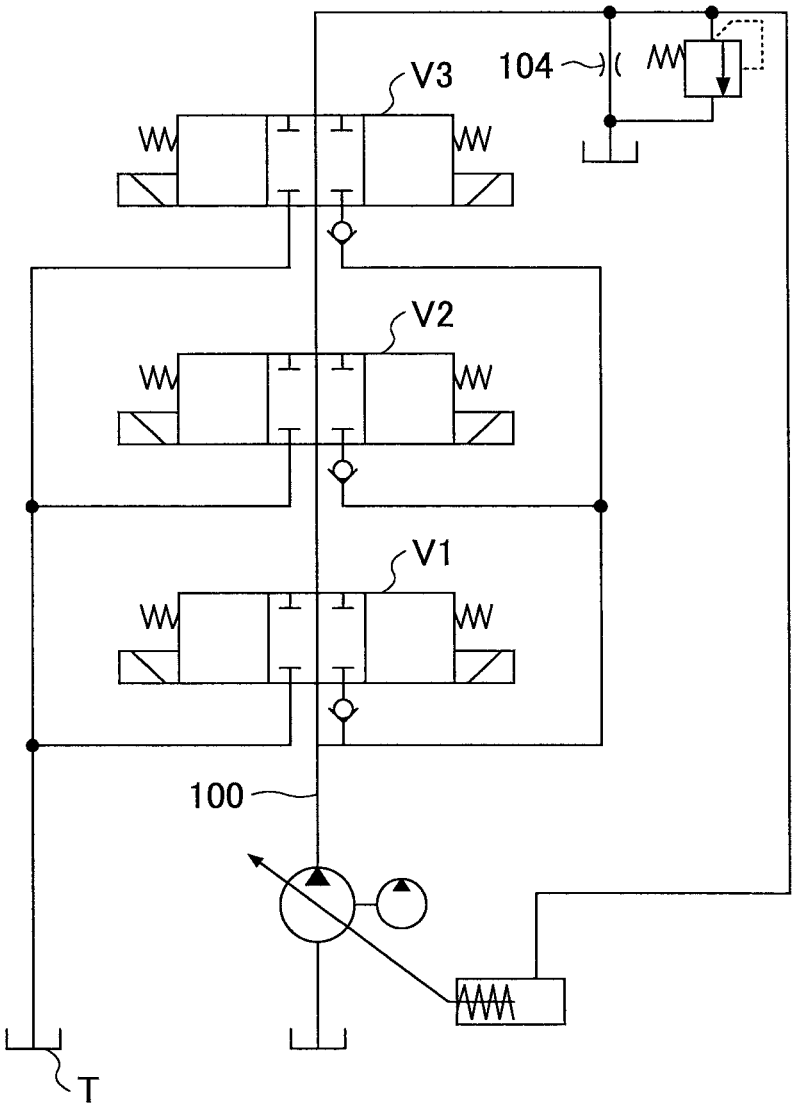
FIG. 7 is a diagram for schematically illustrating an example of a negative control system replicated by the virtual bleed system.

In this virtual bleed system, as an example, such a negative control system as illustrated in FIG. 7 is replicated. In this negative control system, directional control valves V1, V2 and V3 of an open center type (corresponding to the virtual directional control valves in the virtual bleed system) that correspond to the directional control valves 20, 22 and 24 of a closed center type, respectively, are connected in series, and a negative control restriction 104 (corresponding to the virtual negative control restriction in the virtual bleed system) is disposed on a downstream side of a center bypass line 100. It is noted that in FIG. 7 the illustration of the hydraulic actuators (the boom cylinder 7, the arm cylinder 8 and the bucket cylinder 9) which are provided for the corresponding directional control valves V1, V2 and V3 is omitted.

As illustrated in FIG. 6, signals representing the operation amounts of the operation members 40, 42, that is to say, an arm operation amount LS1, a boom operation amount LS2 and a bucket operation amount LS3 are input to the blocks 90 and of the negative and positive systems. Further, the discharge pressure $p_d$ of the hydraulic pump 11 (merely referred to as "pump discharge pressure $p_d$" hereinafter) are input to the blocks 90 and 92 of the negative and positive systems. It is noted that the pump discharge pressure $p_d$ may be a detection value of the oil pressure sensor 30 or a dummy value (see FIG. 9) as described hereinafter.

The arm operation amount LS1, the boom operation amount LS2 and the bucket operation amount LS3 are converted to the opening areas $A_b$ at the corresponding bleed opening data tables (see FIG. 5) 90-1, respectively, and multiplied by corresponding flow coefficients $c_b$ to be input to a block 90-5. The block 90-5 calculates a parameter $c_eA_e$ of the virtual directional control valves as a whole based on a fact that an equivalent opening area $A_e$ of restrictions connected in series can be expressed as follow.

$$A_e = \frac{1}{\sqrt{\sum_{i=1}^{n}\left(\frac{1}{A_i}\right)^2}} \quad \text{[formula 5]}$$

$A_i$ corresponds to virtual bleed opening areas of the respective virtual directional control valves (i.e., the respective virtual directional control valves corresponding to the directional control valves 20, 22 and 24). When the flow coefficients are additionally considered, the following formula is given.

$$c_eA_e = \frac{1}{\sqrt{\sum_{i=1}^{n}\left(\frac{1}{c_iA_i}\right)^2}} \quad \text{[formula 6]}$$

$c_i$ corresponds to flow coefficients of the respective virtual directional control valves (i.e., the respective virtual directional control valves corresponding to the directional control valves 20, 22 and 24). It is noted that i corresponds to the number of the directional control valves (and thus the number of the hydraulic actuators). For example, in the case of a configuration in which only the directional control valve 20 exists, the sigma in the formula is not used (i.e., the product of the flow coefficient c and the opening area A related to the directional control valve 20 is merely calculated).

$c_eA_e$ thus obtained is input to a block 90-6. $A_nC_n$ and the pump discharge pressure $p_d$ are also input to the block 90-6. $A_nc_n$ are obtained by multiplying the opening area $A_n$ at the virtual negative control restriction by the flow coefficient $c_n$ at the virtual negative control restriction, and are input from blocks 90-3 and 90-4. In a bock 90-6, the virtual negative control pressure $p_n$ is calculated based on the formula 4 described above. The virtual negative control pressure $p_n$ thus calculated is input to blocks 90-7 and 90-8.

Figure 8:
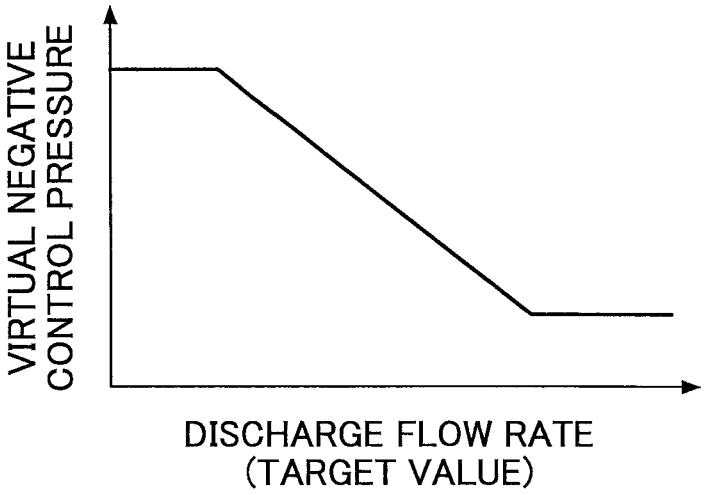
FIG. 8 is a diagram for illustrating examples of a virtual negative control pressure versus flow rate table and a opening area versus flow rate table.
Figure 8:
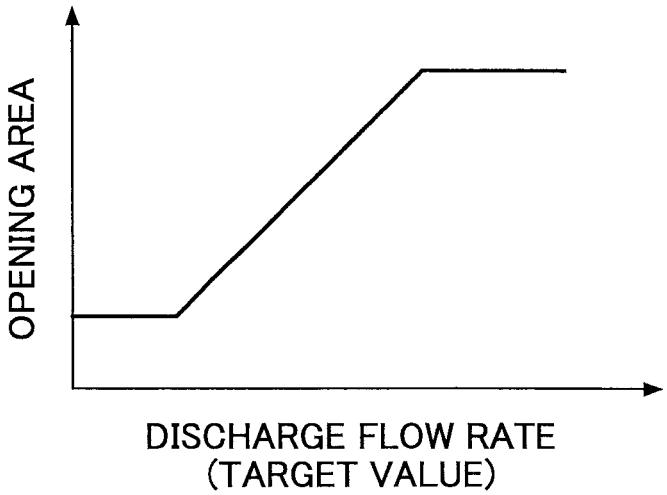

In a block 90-7, the virtual bleed amount $Q_b$ is calculated from the pump discharge pressure $p_d$ and the virtual negative control pressure $p_n$ based on the formula 2 described above. In a block 90-8, the target value $Q_{dt}$ of the discharge flow rate of the hydraulic pump 11 is calculated from the virtual negative control pressure $p_n$ based on a given a virtual negative control pressure versus flow rate table (see FIG. 8 (A)). The target value $Q_{dt}$ of the discharge flow rate of the hydraulic pump 11 is determined based on a control rule of the negative control system. Specifically, the virtual negative control pressure versus flow rate table represents a relationship between the virtual negative control pressure $p_n$ and the target value $Q_{dt}$ of the discharge flow rate of the hydraulic pump 11, and this relationship may be determined based on the assumed control rule of the negative control system. The virtual negative control pressure versus flow rate table illustrated in FIG. 8 (A) has such a relationship that the target value $Q_{dt}$ of the discharge flow rate becomes small when the virtual negative control pressure $p_n$ is high while the target value $Q_{dt}$ of the discharge flow rate becomes great when the virtual negative control pressure $p_n$ is low. According to the virtual bleed system, the virtual bleed amount $Q_b$ is redundant unlike the actual negative control system, and thus the virtual bleed amount $Q_b$ is subtracted from the target value $Q_{dt}$ of the discharge flow rate of the hydraulic pump 11 to calculate an command value (virtual negative control target value) of the discharge flow rate of the hydraulic pump 11. It is noted that a maximum flow rate (horsepower control target value) for a horsepower control is calculated based on an engine rpm and a setting torque, and the smaller of the virtual negative control target value and the horsepower control target value is selected as a final target value, although it is not illustrated.

It is noted that a mode selector 94 switches between a positive control mode for implementing the positive control system and a negative control mode for implementing the negative control system. The mode selector 94 may switch the mode according to the operation of the user or may automatically switch the mode according to a predetermined condition. It is noted that in the positive control mode, the opening area of the actuator line is calculated based on the arm operation amount LS1, the boom operation amount LS2 and the bucket operation amount LS3 in a block 92-1, and command values (positive control target value) of actuator demand flow rates of the hydraulic actuators are calculated based on an opening area versus flow rate table (see FIG. 8 (B)) that represents a relationship between the opening area and the actuator demand flow rate in a block 92-2. It is noted that the actuator demand flow rates of the hydraulic actuators may be calculated directly from an operation amount versus flow rate table based on the arm operation amount LS1, the boom operation amount LS2 and the bucket operation amount LS3. Further, as is the case with the virtual negative control target value, a maximum flow rate (horsepower control target value) for a horsepower control is calculated based on an engine rpm and a setting torque, and the smaller of the positive control target value and the horsepower control target value is selected as a final target value.

In this way, by setting the mode selector 94, it becomes possible to selectively use the positive control system that enables a precise operation or the negative control target value that is in touch with human sensibilities, if necessary.

In this way, according to the embodiment, because the directional control valves 20, 22 and 24 of a closed center type are used, bleeding, which is necessary in the case of the negative control system, becomes unnecessary, which enhances energy conservation. Further, the characteristics of the directional control valve are based on electronic data and thus can be easily changed. Therefore, it becomes possible to easily adjust the characteristics of the directional control valve (the characteristic of the virtual bleed opening area, in particular, see the characteristic C1 in FIG. 5). This holds true for the characteristics of the negative control restriction. Further, because the directional control valves 20, 22 and 24 of a closed center type are used, bleed lines for the directional control valves become unnecessary, which reduces cost of the directional control valves.

Figure 9:
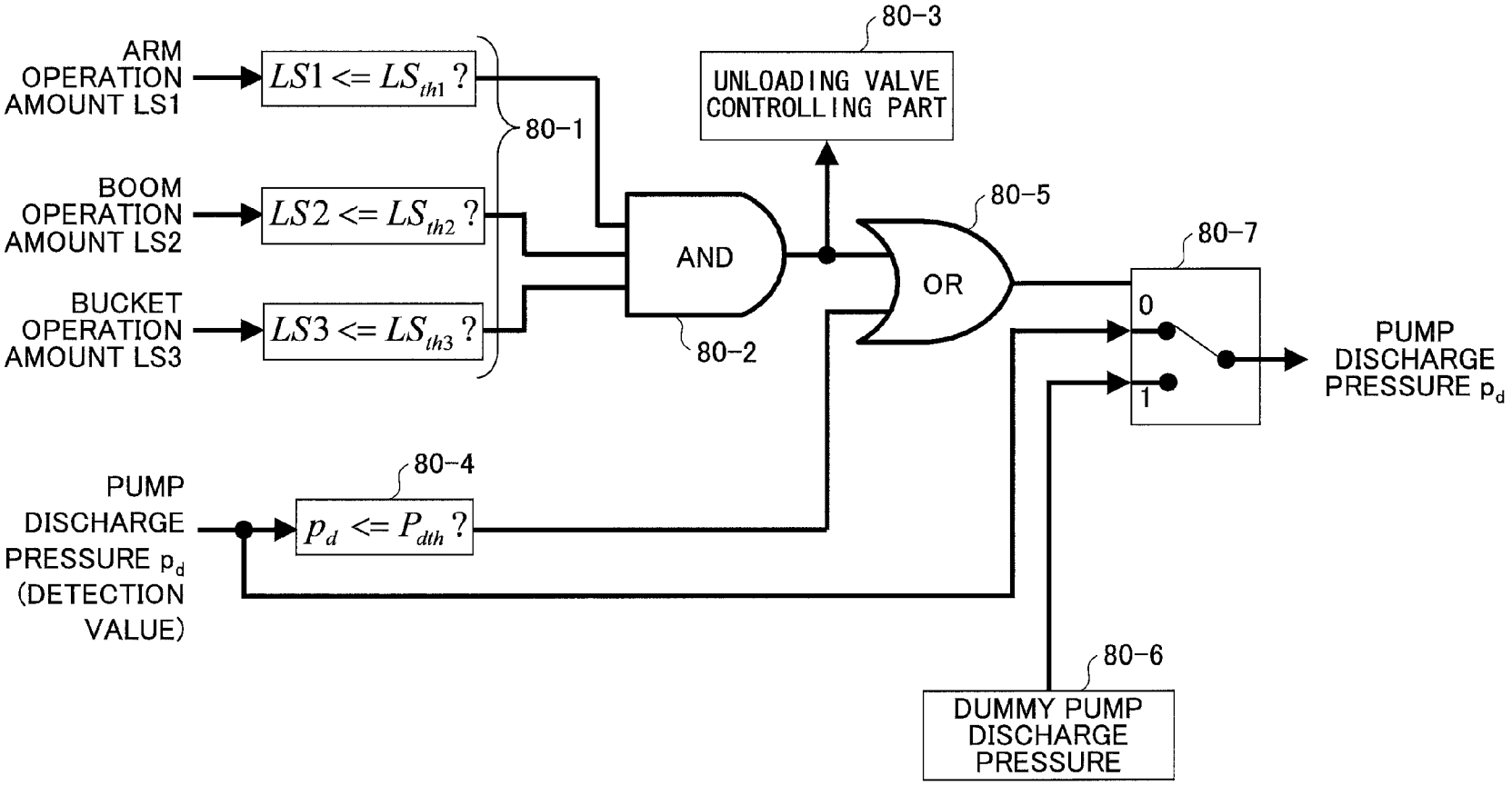
FIG. 9 is an additional part of a block diagram for illustrating the virtual bleed system implemented by the controller 10 according to the embodiment.

FIG. 9 is an additional part of a block diagram for illustrating the virtual bleed system implemented by the controller 10 according to the embodiment. The block diagram illustrated in FIG. 9 is additionally combined with the block diagram (the base part) illustrated in FIG. 6. Specifically, the pump discharge pressure $p_d$ output from the block diagram illustrated in FIG. 9 corresponds to the pump discharge pressure $p_d$ at an input stage in the block diagram (the base part) illustrated in FIG. 6. In other words, the block diagram illustrated in FIG. 9 is a part for calculating the pump discharge pressure $p_d$ at an input stage in the block diagram illustrated in FIG. 6. It is noted that in the block diagram illustrated in FIG. 9 a control block 80-3 of the unloading valve 18 is illustrated together.

As illustrated in FIG. 9, signals representing the operation amounts of the operation members 40, 42, that is to say, an arm operation amount LS1, a boom operation amount LS2 and a bucket operation amount LS3 are input to a block 80-1. In the block 80-1, it is determined whether the arm operation amount LS1, the boom operation amount LS2 and the bucket operation amount LS3 are smaller than or equal to corresponding predetermined thresholds $LS_{th1}$ $LS_{th2}$ and $LS_{th3}$, respectively. The predetermined thresholds $LS_{th1}$, $LS_{th2}$ and $LS_{th3}$ correspond to the operation amounts when the actuator lines of the directional control valves 20, 22 and 24 start to open. Thus, when the arm operation amount LS1, the boom operation amount LS2 and the bucket operation amount LS3 are smaller than or equal to corresponding predetermined thresholds $LS_{th1}$, $LS_{th2}$ and $LS_{th3}$, the actuator lines of the directional control valves 20, 22 and 24 are in the closed state.

The determination results in the block 80-1 are input to an AND gate at a block 80-2 where High (level) is output only if all the determination results are affirmative. Thus, when the arm operation amount LS1, the boom operation amount LS2 and the bucket operation amount LS3 are smaller than or equal to corresponding predetermined thresholds $LS_{th1}$ $LS_{th2}$ and $LS_{th3}$, respectively, High is output, but when at least one of the arm operation amount LS1, the boom operation amount LS2 and the bucket operation amount LS3 is greater than the corresponding predetermined thresholds $LS_{th1}$, $LS_{th2}$ or $LS_{th3}$, Low is output. The output of the block 80-2 is input to blocks 80-3 and 80-5.

In the block 80-3, when the output of the block 80-2 is High, an instruction that causes the unloading valve 18 to open is generated. Therefore, when the actuator lines of the directional control valves 20, 22 and 24 are closed, such a state is formed in which the oil discharged from the hydraulic pump 11 is discharged to the tank T. On the other hand, when the output of the block 80-2 is Low, an instruction that causes the unloading valve to be closed is generated. Therefore, when at least one of the actuator lines of the directional control valves 20, 22 and 24 is in the open state, such a state is formed in which all the oil discharged from the hydraulic pump 11 is flowed through the open actuator line.

A signal that represents the pump discharge pressure $p_d$ is input to a block 80-4. It is noted that the pump discharge pressure $p_d$ may be a detection value of the oil pressure sensor 30. In a block 80-4, it is determined whether the pump discharge pressure $p_d$ is smaller than or equal to a predetermined threshold $P_{dth}$. The predetermined threshold $P_{dth}$ corresponds to an uncontrollable pump discharge pressure $p_d$. The predetermined threshold $P_{dth}$ is 0, for example. The determination result at the block 80-4 is input to an OR gate at a block 80-5 together with the output of the block 80-2. In this way, when the pump discharge pressure $p_d$ is smaller than or equal to the predetermined threshold $P_{dth}$ or the actuator lines of the directional control valves 20, 22 and 24 are closed, High is output from the block 80-5. On the other hand, when the pump discharge pressure $p_d$ is greater than the predetermined threshold $P_{dth}$ and at least one of the actuator lines of the directional control valves 20, 22 and 24 is in the open state, Low is output. It is noted the blocks 80-4 and 80-5 may be omitted.

A signal that represents the pump discharge pressure $p_d$ is input to a block 80-7. It is noted that the pump discharge pressure $p_d$ may be a detection value of the oil pressure sensor 30. Further, a dummy pump discharge pressure (dummy value) from a block 80-6 is input to a block 80-7. The dummy pump discharge pressure is such a value that the command value of the discharge flow rate of the hydraulic pump 11 calculated based on that value (output of the block diagram illustrated in FIG. 6) becomes a predetermined flow rate. Thus, the dummy pump discharge pressure may be derived by calculating backward from the predetermined flow rate. The predetermined flow rate may be a flow rate suited for a standby state. For example, the predetermined flow rate may be a minimum discharge flow rate (a minimum discharge flow rate which can be implemented when power is turned on, for example) of the hydraulic pump 11.

A block 80-7 functions as a switch for selecting the pump discharge pressure $p_d$ (the detection value of the oil pressure sensor 30) or the dummy pump discharge pressure (the dummy value) from the block 80-6 according to the input from the block 80-5. Specifically, when the input from the block 80-5 is High, the dummy pump discharge pressure (the dummy value) from the block 80-6 is selected and output to a downstream stage. On the other hand, when the input from the block 80-5 is Low, the pump discharge pressure $p_d$ (the detection value of the oil pressure sensor 30) is selected and output to a downstream stage.

In this way, according to the block diagram illustrated in FIG. 9, when the pump discharge pressure $p_d$ is smaller than or equal to a predetermined threshold $P_{dth}$ or the actuator lines of the directional control valves 20, 22 and 24 are closed, the dummy pump discharge pressure (the dummy value) is output. On the other hand, when the pump discharge pressure $p_d$ is greater than the predetermined threshold $P_{dth}$ and at least one of the actuator lines of the directional control valves 20, 22 and 24 is in the open state, the pump discharge pressure $p_d$ (the detection value of the oil pressure sensor 30) is output. The dummy pump discharge pressure or the pump discharge pressure $p_d$ thus output is used as an input to the block diagram (the base part) illustrated in FIG. 6. It is noted that if the number of the directional control valve is 1, dummy pump discharge pressure (the dummy value) is output when the actuator line of the directional control valve is closed.

When the actuator lines of the directional control valves 20, 22 and 24 are closed, the unloading valve 18 is opened as described above. Thus, the oil discharged from the hydraulic pump 1 is discharged to the tank T. During discharging the excess flow rate at the unloading valve 18, the pump discharge pressure $p_d$ (the detection value of the oil pressure sensor 30) becomes close to 0 because of little restriction. In this case, if the negative control system is virtually replicated using the pump discharge pressure $p_d$ (the detection value of the oil pressure sensor 30), the calculated value of the virtual negative control pressure $p_n$ is substantially 0 (see the block 90-6 in FIG. 6). Thus, such an command value (that instructs a maximum flow rate, for example) that causes the discharge flow rate of the hydraulic pump 11 to increase is generated from the virtual negative control pressure versus flow rate table (see the block 90-8 in FIG. 6 and FIG. 8 (A)), which leads to a problem that energy is wasted. Such a problem also occurs when the pump discharge pressure $p_d$ (the detection value of the oil pressure sensor 30) is smaller than or equal to the predetermined threshold $P_{dth}$, even if the unloading valve 18 is not in the open state.

In contrast, according to the embodiment, as described above, when the actuator lines of the directional control valves 20, 22 and 24 are closed (ditto for the case where the pump discharge pressure $p_d$ (the detection value of the oil pressure sensor 30) is smaller than or equal to the predetermined threshold $P_{dth}$), the command value of the discharge flow rate of the hydraulic pump 11 (output of the block diagram illustrated in FIG. 6) is determined based on the dummy pump discharge pressure. Therefore, such a problem can be appropriately prevented. Specifically, because the command value of the discharge flow rate of the hydraulic pump 11 calculated based on the dummy pump discharge pressure corresponds to the predetermined flow rate (the flow rate suited for a standby state, for example, as described above), it is possible to prevent the discharge flow rate of the hydraulic pump 11 from being unnecessarily great. In this way, it is possible to stabilize the control even in a situation where the pump discharge pressure $p_d$ (the detection value of the oil pressure sensor 30) is low.

It is noted that in the embodiment described above the pump discharge pressure $p_d$ is replaced with the dummy value; however, the same effect can be obtained when another parameter is replaced with a dummy value as well. Specifically, the same effect can be obtained by correcting the command value of the discharge flow rate of the hydraulic pump 11 (output of the block diagram illustrated in FIG. 6) itself or correcting any parameters used to calculate the command value of the discharge flow rate of the hydraulic pump 11. For example, the virtual negative control pressure $p_n$ may be replaced with an appropriate dummy value or the command value of the discharge flow rate of the hydraulic pump 11 itself may be replaced with an appropriate dummy value (the predetermined flow rate described above). Alternatively, the characteristics of the virtual negative control pressure versus flow rate table (see FIG. 8 (A)) used in the block 90-8 in FIG. 6 may be changed.

It is noted that, in the embodiment described above, the block 80-3 in FIG. 9 implements "an unloading valve controlling part" recited in claims, the blocks (the block 90 in FIG. 6) for calculating the command value of the discharge flow rate of the hydraulic pump 11 implements "an command value calculating part" recited in claims, and the blocks 80-6 and 80-7 in FIG. 9 implements "a correcting part" recited in claims.

Figure 10:
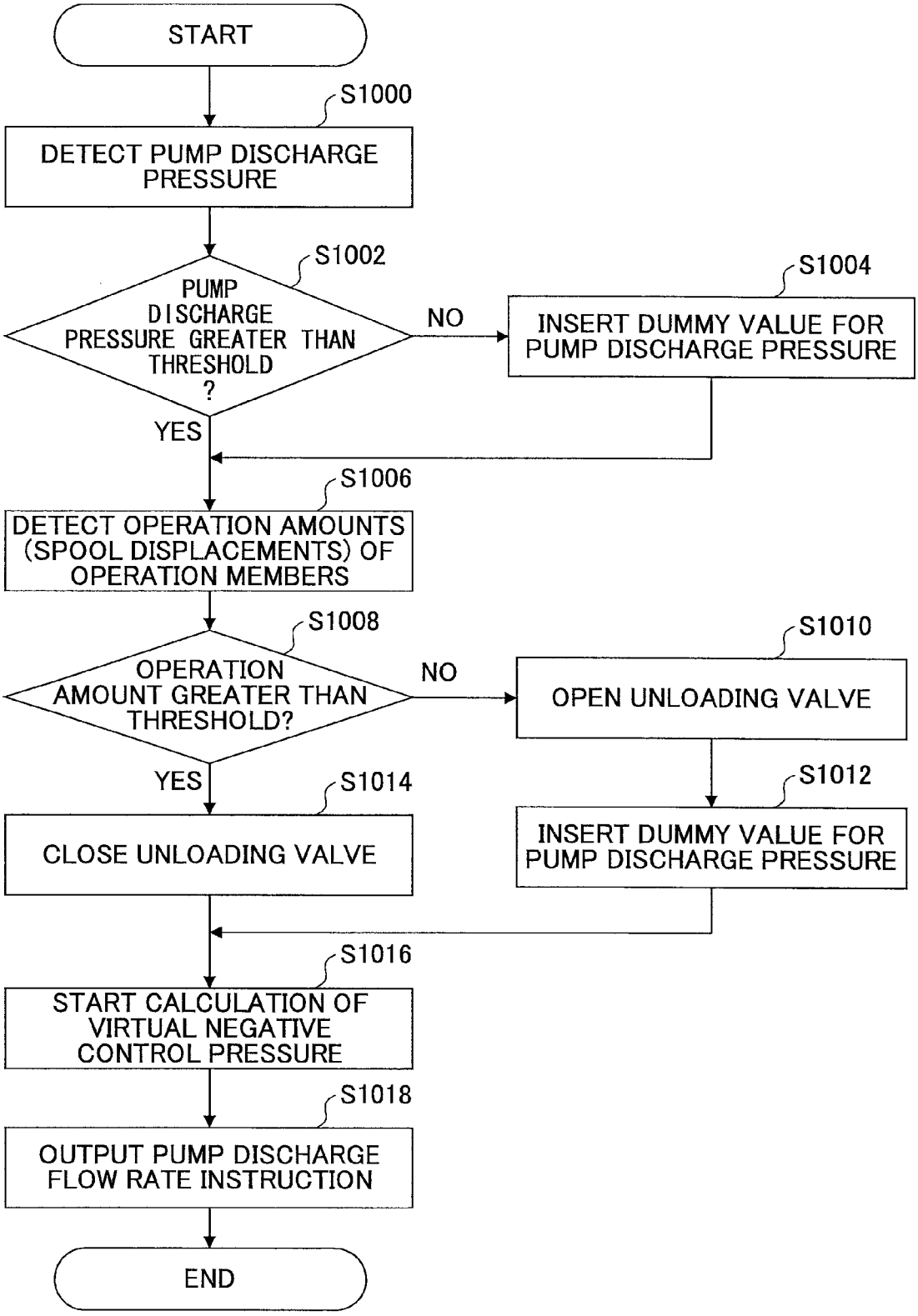
FIG. 10 is a flowchart for illustrating an example of a main process executed by a hydraulic control system 60 according to the embodiment.

FIG. 10 is a flowchart for illustrating an example of a main process executed by the hydraulic control system 60 according to the embodiment. The process illustrated in FIG. 10 may be executed based on the configuration illustrated in FIGS. 6 and 8 and described above. A process routine illustrated in FIG. 10 may be executed repeatedly at a predetermined cycle.

In step 1000, the pump discharge pressure is detected by the oil pressure sensor 30.

In step 1002, it is determined whether the pump discharge pressure detected by the oil pressure sensor 30 is greater than the predetermined threshold $P_{dth}$. If the pump discharge pressure is greater than the predetermined threshold $P_{dth}$, the process routine goes to step 1006. On the other hand, if the pump discharge pressure is smaller than or equal to the predetermined threshold $P_{dth}$, the process routine goes to step 1004.

In step 1004, the dummy value (dummy pump discharge pressure) is inserted with respect to the pump discharge pressure detected by the oil pressure sensor 30. The dummy pump discharge pressure is such a value that the command value of the discharge flow rate of the hydraulic pump 11 calculated based on that value becomes the predetermined flow rate (the minimum discharge flow rate of the hydraulic pump 11, for example), as described above.

In step 1006, the operation amounts (spool displacements) of the operation members 40, 42 and 43, that is to say, the arm operation amount, the boom operation amount and the bucket operation amount are detected.

In step 1008, it is determined whether at least one of the operation amounts of the operation members 40, 42 and 43 is greater than the corresponding predetermined thresholds $LS_{th1}$, $LS_{th2}$ or $LS_{th3}$. If at least one of the operation amounts of the operation members 40, 42 and 43 is greater than the corresponding predetermined thresholds $LS_{th1}$, $LS_{th2}$ or $LS_{th3}$, the process routine goes to step 1014. On the other hand, if the operation amounts of the operation members 40, 42 and 43 are smaller than or equal to the corresponding predetermined thresholds $LS_{th1}$ $LS_{th2}$ and $LS_{th3}$, respectively, the process routine goes to step 1010.

In step 1010, the unloading valve 18 is opened. As a result of this, when the actuator lines of the directional control valves 20, 22 and 24 are closed, such a state is formed in which the oil discharged from the hydraulic pump 11 is discharged to the tank T.

In step 1012, as in step 1004, the dummy value (dummy pump discharge pressure) is inserted with respect to the pump discharge pressure detected by the oil pressure sensor 30. It is noted that if the dummy value has already been inserted at step 1004, the process of step 1012 may be omitted.

In step 1014, the unloading valve 18 is closed. As a result of this, when at least one of the actuator lines of the directional control valves 20, 22 and 24 is in the open state, such a state is formed in which all the oil discharged from the hydraulic pump 11 is flowed through the open actuator line.

In step 1016, the virtual negative control pressure $p_n$ is calculated based on the pump discharge pressure detected by the oil pressure sensor 30 or the dummy pump discharge pressure. Specifically, if the process of step 1004 or step 1014 is performed, the virtual negative control pressure $p_n$ is calculated based on dummy pump discharge pressure, and otherwise the virtual negative control pressure $p_n$ is calculated based on the pump discharge pressure detected by the oil pressure sensor 30.

In step 1018, the command value of the discharge flow rate of the hydraulic pump 11 is calculated. It is noted that if the virtual negative control pressure $p_n$ is calculated based on the dummy pump discharge pressure, the calculated command value of the discharge flow rate of the hydraulic pump 11 corresponds to the predetermined flow rate (the minimum discharge flow rate of the hydraulic pump 11, for example).

It is noted that, in the embodiment described above, step 1016 and step 1018 in FIG. 10 implement "an command value calculating part" recited in claims, and step 1004 and step 1012 in FIG. 10 implements "a correcting part" recited in claims.

The present invention is disclosed with reference to the preferred embodiments. However, it should be understood that the present invention is not limited to the above-described embodiments, and variations and modifications may be made without departing from the scope of the present invention.

What is claimed is:

1. A hydraulic control apparatus that controls a hydraulic pump in a construction machine in which a hydraulic actuator is connected to the hydraulic pump via a directional control valve of a closed center type, and in which an unloading valve, which is connected to a tank, is provided between the directional control valve and the hydraulic pump, the hydraulic control apparatus comprising an electronic controller, the electronic controller being configured to:

control the unloading valve such that fluid communication between the hydraulic pump and the tank is blocked in a situation where the directional control valve is in a first state that a fluid path to the hydraulic actuator is opened, and such that the fluid communication between the hydraulic pump and the tank is established in a situation where the directional control valve is in a second state that the fluid path to the hydraulic actuator is closed;

calculate a virtual bleed opening area from a given virtual bleed opening area characteristic related to the directional control valve, based on an operation amount of an operation member for changing a position of the directional control valve, under the situation where the directional control valve is in the first state, calculate, based on the calculated virtual bleed opening area and a discharge pressure of the hydraulic pump, a virtual negative control pressure when a negative control system is assumed, and calculate a first control command value for the hydraulic pump based on the virtual negative control pressure;

calculate a second control command value for the hydraulic pump when the directional control valve is in the second state, the second control command value being calculated using a dummy value so that a discharge flow rate of the hydraulic pump becomes a predetermined flow rate; and control the hydraulic pump based on the first control command value when the directional control valve is in the first state, and control the hydraulic pump based on the second control command value when the directional control valve is in the second state.

2. The hydraulic control apparatus of claim 1, wherein the predetermined flow rate corresponds to a minimum discharge flow rate of the hydraulic pump.

3. A method of controlling a hydraulic pump in a construction machine in which a hydraulic actuator is connected to the hydraulic pump via a directional control valve of a closed center type, and in which an unloading valve, which is connected to a tank is provided between the directional control valve and the hydraulic pump, the method comprising:

controlling the unloading valve such that fluid communication between the hydraulic pump and the tank is blocked, calculating, a virtual bleed opening area from a given virtual bleed opening area characteristic related to the directional control valve based on an operation amount of an operation member for changing a position of the directional control valve, then calculating, based on the calculated virtual bleed opening area and a discharge pressure of the hydraulic pump, a virtual negative control pressure when a negative control system is assumed, and calculating a first control command value for the hydraulic pump based on the virtual negative control pressure, under a situation where the directional control valve is in a first state that a fluid path to the hydraulic actuator is opened;

controlling the unloading valve such that fluid communication between the hydraulic pump and the tank is established, and calculating a second control command value for the hydraulic pump, under a situation where the directional control valve is in a second state that the fluid path to the hydraulic actuator is closed, the second control command value being calculated using a dummy value so that a discharge flow rate of the hydraulic pump becomes a predetermined flow rate; and controlling the hydraulic pump based on the first control command value when the directional control valve is in the first state, and controlling the hydraulic pump based on the second control command value when the directional control valve is in the second state.

4. A hydraulic control apparatus that controls a hydraulic pump in a construction machine in which a hydraulic actuator is connected to the hydraulic pump via a directional control valve of a closed center type, and in which an unloading valve, which is connected to a tank, is provided between the directional control valve and the hydraulic pump, the hydraulic control apparatus comprising an electronic controller, the electronic controller being configured to:

control the unloading valve such that fluid communication between the hydraulic pump and the tank is blocked in a situation where the directional control valve is in a first state that a fluid path to the hydraulic actuator is opened, and such that the fluid communication between the hydraulic pump and the tank is established in a situation where the directional control valve is in a second state that the fluid path to the hydraulic actuator is closed;

calculate a virtual bleed opening area from a given virtual bleed opening area characteristic related to the directional control valve, based on an operation amount of an operation member for changing a position of the directional control valve, and pump when the directional control valve is in the first state, based on the calculated virtual bleed opening area and a discharge pressure of the hydraulic pump;

calculate a second control command value for the hydraulic pump when the directional control valve is in the second state, the second control command value being calculated so that a discharge flow rate of the hydraulic pump becomes a predetermined flow rate; and control the hydraulic pump based on the first control command value when the directional control valve is in the first state, and control the hydraulic pump based on the second control command value when the directional control valve is in the second state.

* * * * *